United States Patent [19]

Matsuura

[11] 4,145,470

[45] Mar. 20, 1979

[54] FILM RESISTOR HAVING A REDUCED TEMPERATURE COEFFICIENT OF RESISTANCE

[75] Inventor: Masaaki Matsuura, Yokohama, Japan

[73] Assignee: Nippon Kogaku K.K., Tokyo, Japan

[21] Appl. No.: 792,107

[22] Filed: Apr. 29, 1977

[30] Foreign Application Priority Data

May 6, 1976 [JP] Japan ..... 51-50791

[51] Int. Cl.[2] ..... H01C 1/034; H01C 7/102

[52] U.S. Cl. ..... 428/336; 428/428; 428/432; 428/433; 428/446; 428/539; 427/102; 427/103; 427/248 A; 427/248 B; 427/248 J; 338/308; 338/309; 338/262; 29/613; 29/619

[58] Field of Search ..... 427/102, 103, 126, 248 A, 427/248 B, 248 J; 338/308, 309, 262; 428/428, 432, 433, 539, 334–336; 29/613, 619

[56] References Cited

U.S. PATENT DOCUMENTS

| | | | |
|---|---|---|---|
| 2,761,945 | 9/1956 | Colbert et al. | 338/308 |
| 3,203,830 | 8/1965 | Ostrander et al. | 338/308 |
| 3,356,982 | 12/1967 | Solow | 427/103 |
| 3,380,156 | 4/1968 | Lood et al. | 338/308 |
| 4,038,517 | 7/1977 | Nelson | 427/103 |

*Primary Examiner*—Michael F. Esposito

*Attorney, Agent, or Firm*—Fitzpatrick, Cella, Harper & Scinto

[57] ABSTRACT

In a film resistor comprising a substrate of insulative material and a film of Cermet formed as resistance material on the substrate, a protective film of insulative material is formed on the surface of the film of Cermet to reduce the temperature coefficient of resistance of the film resistor. The protective film is formed of magnesium fluoride.

11 Claims, 2 Drawing Figures

FILM RESISTOR HAVING A REDUCED TEMPERATURE COEFFICIENT OF RESISTANCE

BACKGROUND OF THE INVENTION

1. Field of the Invention

This invention relates to a film resistor having a reduced temperature coefficient of resistance and a method of making the same.

2. Description of the Prior Art

Film resistors having recently been rising in importance and more film resistors have been produced and used while, at the same time, the various characteristics required of them have become ever more exacting. Of these characteristics, it is particularly important to reduce the temperature coefficient of resistance.

Reduction in temperature coefficient of resistance of film resistors has heretofore been accomplished by choosing the resistance material. For example, where Cermet comprising 60–40% by weight of chromium and 40–60% by weight of silicon monoxide has been chosen as the resistance material, the temperature coefficient of resistance of this film resistor has been −200 ppm/° C or lower. The sign prefixed to the value of the temperature coefficient of resistance shown above, represents the variation in the coefficient with respect to temperature rise, a minus sign indicating a variation of decrease and a plus sign indicating a variation for increase. To further reduce such temperature coefficient of resistance of −200 pm/° C, tantalum nitride has been chosen as the resistance material. For tantalum nitride so chosen, a method has been developed which can produce from it a film resistor having a temperature coefficient of resistance of ±50 ppm/° C. This method has involved the steps of forming resistance material of tantalum nitride on a substrate by sputtering, and subjecting the film resistor to a heat treatment. This method however, has been disadvantages not only in that the sputtering apparatus is expensive, but also in that the temperature coefficient of resistance is greatly governed by the temperature of the heat treatment.

SUMMARY OF THE INVENTION

I have conceived and contribute by the present invention a film resistor whose temperature coefficient of resistance has been reduced down to ±50 ppm/° C by using Cermet as the resistance material, and also a method of making such film resistor.

According to the present invention, the film resistor comprises a substrate of insulative material and a film of Cermet formed as a resistance material on the substrate. A protective film of insulative material is formed on the surface of the Cermet film to reduce the temperature coefficient of resistance of the film resistor. The protective film may be formed of magnesium fluoride.

According to the present invention, there is also provided a method of making a film resistor having a reduced temperature coefficient of resistance, which method comprises the steps of evaporating a film of Cermet as resistance material onto a substrate of insulative material while heating the substrate, and evaporating onto the surface of the Cermet film an insulative protective film formed of magnesium fluoride while heating the substrate and the Cermet film.

The invention will become more fully apparent from the following detailed description thereof taken in conjunction with the accompanying drawings.

There has thus been outlined rather broadly the more important features of the invention in order that the detailed description thereof that follows may be better understood and in order that the present contribution to the art may be better appreciated. There are, of course, additional features of the invention that will be described hereinafter and which will form the subject of the claims appended hereto. Those skilled in the art will appreciate that the conception upon which this disclosure is based may readily be utilized as a basis for the designing of other structures for carrying out the several purposes of the invention. It is important, therefore, that the claims be regarded as including such equivalent constructions as do not depart from the spirit and scope of the invention.

BRIEF DESCRIPTION OF THE DRAWINGS

Specific embodiments of the invention have been chosen for purposes of illustration and description, and are shown in the accompanying drawings forming a part of the specification wherein.

DESCRIPTION OF THE PREFERRED EMBODIMENTS

Description will first be made of the temperature coefficient of resistance obtained where Cermet is used as the resistance material according to the prior art method. The Cermet is evaporated onto a substrate of insulative material such as alumina ($Al_2O_3$) or glass by evaporating means. The temperature coefficients of resistance (TCR) measured in such instance will be shown in Table 1 below, wherein the measurement of $TCR_{20}^{60}$ and $TCR_{20}^{-20}$ represent the variation per 1° C at the temperature condition of 60° C or −20° C with respect to the reference temperature condition (20° C). More specifically, where the resistance values at temperatures 60° C, 20° C and −20° C are R60, R20 and R−20, respectively, $$TCR_{20}^{60} = \frac{(R60) - (R20)}{(R20) \times (60^\circ\,C - 20^\circ\,C)}$$

and $$TCR^{-20}_{20} = \frac{(R20) - (R - 20)}{(R20) \times \{20^\circ\,C - (-20^\circ\,C)\}}$$

These will hereinafter be described as $TCR_{20}^{60}$ or $TCR_{20}^{-20}$. Table 1 shows the measurements of $TCR_{20}^{60}$ and $TCR_{20}^{-20}$ effected on ten different samples but under the same conditions. The unit of measurement is ppm/° C.

TABLE 1

| Samples | $TCR_{20}^{60}$ | (Unit: ppm/° C) $TCR^{-20}_{20}$ |
|---|---|---|
| 1 | −143.4 | −155.1 |
| 2 | −114.9 | −139.1 |
| 3 | −285.9 | −404.1 |
| 4 | −269.8 | −318.7 |
| 5 | −323.1 | −384.1 |
| 6 | − 98.3 | −102.5 |
| 7 | −139.5 | −151.1 |
| 8 | −220.3 | −244.0 |
| 9 | −337.5 | −361.1 |

TABLE 1-continued

| Samples | $TCR_{20}^{60}$ | (Unit: ppm/° C) $TCR_{20}^{-20}$ |
|---|---|---|
| 10 | −320.7 | −360.7 |
| Average | −225.3 | −299.9 |

Figure 1:
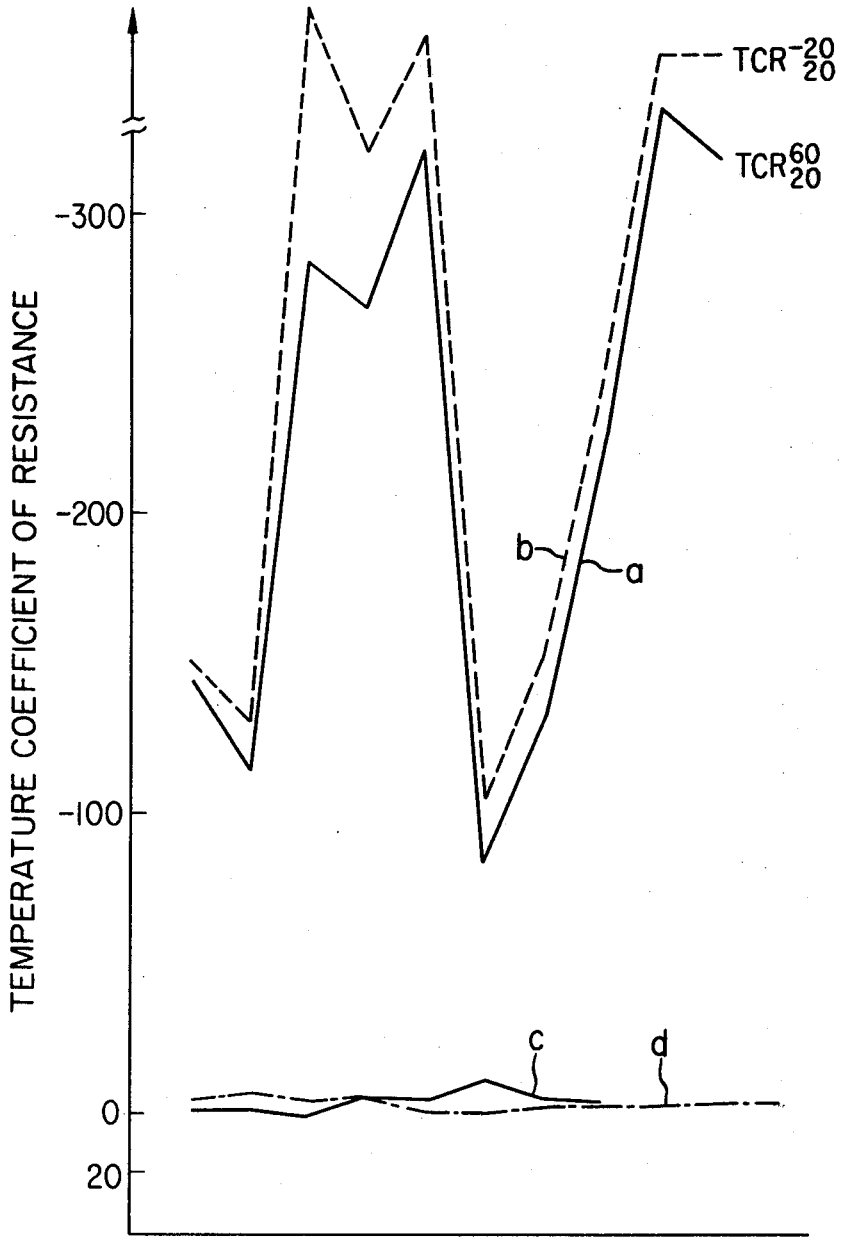
FIG. 1 is a graph illustrating the temperature coefficient of resistance of the film resistor according to the prior art and the temperature of coefficient of resistance of the film resistor according to the present invention.

FIG. 1 graphically illustrates the values of $TCR_{20}^{60}$ and $TCR_{20}^{-20}$ shown in Table 1. In the graph, curva *a* represents $TCR_{20}^{60}$ and curve *b* represents $TCR_{20}^{-20}$. As is apparent from the data of Table 1 above or the curves *a, b* of FIG. 1, the temperature coefficients of resistance are very high and considerably irregular in the prior art film resistors.

Figure 2:
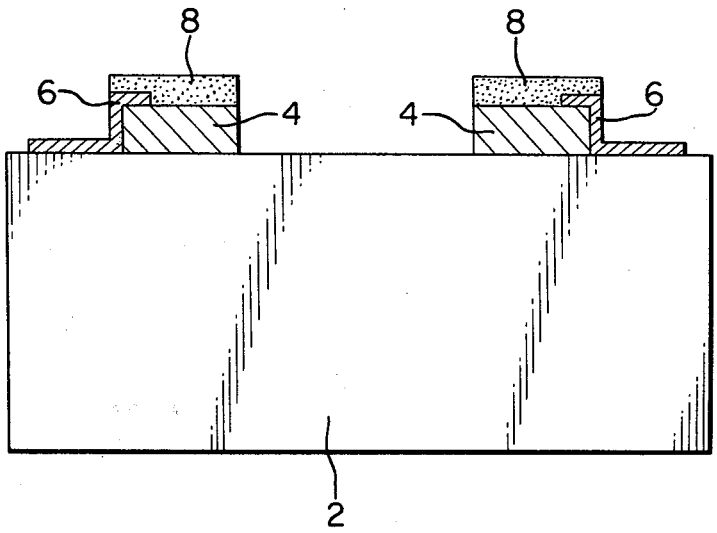
FIG. 2 is a cross-sectional view of the film resistor according to the present invention.

FIG. 2 is a cross-sectional view of the film resistor according to the present invention. A first embodiment of the present invention will now be described in detail by reference to FIG. 2. Initially, Cermet 4, comprising 60–40% by weight of chromium and 40–60% by weight of silicon monoxide, is evaporated onto a substrate 2 of insulative material such as alumina or glass while the substrate 2 is being heated to a temperature of between about 285° C and 315° C. The resultant thickness of evaporated film ranges from about 0.8 to 2.00 microns. Thereafter, an electrode 6 is provided on the substrate 2 so as to be electrically connected to the Cermet 4. Part of the electrode 6 and part of the surface of the Cermet 4 overlap each other. Subsequently, magnesium fluoride ($MgF_2$), which is an insulative material, is evaporated onto the Cermet 4 so as to cover the surface of the Cermet 4 while the substrate 2 and Cermet 4 are being heated to a temperature of between about 285° C and 315° C. The thickness of the so evaporated layer ranges from about 0.03 to 2.00 microns. The layer of magnesium fluoride 8 is not fragmentary but covers the entire area of the Cermet 4. In this embodiment, the Cermet is vacuum-evaporated to a thickness of 0.20 micron. Table 2 below shows the measurements of $TCR_{20}^{60}$ effected on eight different samples but under the same conditions.

TABLE 2

| Sample | (Unit: ppm/° C) $TCR_{20}^{60}$ |
|---|---|
| 1 | −1.8 |
| 2 | −3.1 |
| 3 | 0.0 |
| 4 | −6.0 |
| 5 | −4.9 |
| 6 | − 11.5 |
| 7 | −5.5 |
| 8 | −4.8 |
| Average | −4.7 |

The evaporating means in the foregoing may be vacuum evaporation, sputtering or CVD method, of which vacuum evaporation is employed in the present embodiment. In FIG. 1, the data of Table 2 are represented by curve C. As will be seen from the data Table 1 and the curve C in the graph of FIG. 1, the temperature coefficient of resistance of the resistor is very low and reduced in irregularity. In the present embodiment, only the data of $TCR_{20}^{60}$ are shown, but as is apparent from the curves *a* and *b* representing the data of the prior art film resistor, the values of $TCR_{20}^{-20}$ would be substantially approximate to the values of $TCR_{20}^{60}$ and it is therefore expected also in the present embodiment that the values of $TCR_{20}^{-20}$ would be nearly as low and as free of irregularity as the values of $TCR_{20}^{60}$. In the present embodiment, the evaporation of magnesium fluoride 8 was carried out while the resistor 4 was being heated to a temperature of between about 285° C and 315° C, whereas when the evaporation of magnesium fluoride 8 was effected without the resistance material 4 being heated, there was obtained no such result that the temperature coefficient of resistance was less than ±50 ppm/° C.

A second embodiment of the present invention will now be described. In the embodiment described above, it has been successful to reduce the temperature coefficient of resistance simply by evaporating magnesium fluoride 8 onto the conventional resistance material such as Cermet 4 or the like. According to the second embodiment, after the evaporation of magnesium fluoride 8, the film resistor is subjected to a heat treatment comprising leaving the film resistor in air at a temperature of between about 300° C and 350° C for 2 to 4 hours, thereby to reduce the temperature coefficient of resistance. The measurements of $TCR_{20}^{60}$ effected on a single sample under the same condition are shown in Table 3 below. The other conditions than the heat treatment are the same as those in the first embodiment.

TABLE 3

| Sample | (Unit: ppm/° C) $TCR_{20}^{60}$ |
|---|---|
| 1 | −5.0 |
| 2 | −7.9 |
| 3 | −5.4 |
| 4 | −5.0 |
| 5 | −1.9 |
| 6 | −1.2 |
| 7 | −3.6 |
| 8 | −3.6 |
| 9 | −3.5 |
| 10 | −4.5 |
| 11 | −4.9 |
| Average | −4.2 |

The data of Table 3 are represented by curve *d* in the graph of FIG. 1. As seen from Table 3 and the curve *d* in the graph of FIG. 1, the temperature coefficient of resistance is low and free of irregularity. In this embodiment, the heat treatment comprises leaving the film resistor in the air at about 300° C for three hours after the evaporation of magnesium fluoride. Alternatively the time of heat treatment may be 2 to 4 hours and the temperature of heat treatment may be between about 300° C and 350° C.

Thus, according to the present invention, it is possible to provide a film resistor whose temperature coefficient of resistance has been not only greatly reduced, but also decreased in irregularity by newly adding the step of evaporating magnesium fluoride onto the resistance material but without altering the existing apparatus and method for making resistance material of Cermet, and also to provide a method of making such film resistor.

I believe that the construction of my novel film resistor and the method of making same will now be understood and that the advantages thereof will be fully appreciated by those persons skilled in the art.

I claim:

1. A film resistor having a low temperature coefficient of resistance comprising a substrate of insulative material, a film of Cermet formed on the substrate as a resistance, and a protective film of insulative material formed on the Cermet film to reduce the temperature coefficient of resistance, the protective film being formed of magnesium fluoride ($MgF_2$).

2. A film resistor according to claim 1, further comprising an electrode film provided on said substrate and electrically connected to said film of Cermet, part of said electrode film overlapping part of the surface of said film of Cermet.

3. A film resistor according to claim 2, wherein said film of Cermet is composed of the order of 60–40% by weight of chromium and of the order of 40–60% by weight of silicon monoxide.

4. A film resistor according to claim 3, wherein said film of Cermet has a thickness of the order of 0.08 to 2.00 microns and said protective film has a thickness of the order of 0.03 to 2.00 microns.

5. A film resistor according to claim 4, wherein said substrate of insulative material is composed of glass.

6. A film resistor according to claim 4, wherein said substrate of insulative material is composed of alumina.

7. A method of making a film resistor having a reduced temperature coefficient of resistance, comprising the steps of evaporating a film of Cermet as a resistance material onto a substrate of insulative material while heating said substrate, and evaporating onto the surface of said film of Cermet an insulative protective film formed of magnesium fluoride while heating said substrate and said film of Cermet.

8. A method according to claim 7, wherein the heating temperature during the evaporation of said film of Cermet and said protective film is of the order of between 285° C and 315° C.

9. A method according to claim 7, further comprising the step of subjecting said film resistor to a heat treatment after the evaporation of said protective film.

10. A method according to claim 9, wherein said heat treatment comprises leaving said film resistor in air at a temperature of between about 300° C and 350° C for 2 to 4 hours.

11. A method according to claim 10, wherein after the evaporation of said film of Cermet, an electrode film is evaporated so that part of said film of Cermet and part of said electrode film overlap each other.

* * * * *

UNITED STATES PATENT AND TRADEMARK OFFICE

CERTIFICATE OF CORRECTION

PATENT NO. : 4,145,470

DATED : March 20, 1979

INVENTOR(S) : Masaaki Matsuura

It is certified that error appears in the above-identified patent and that said Letters Patent are hereby corrected as shown below:

On the Title page the illustrative drawing should appear as shown below.

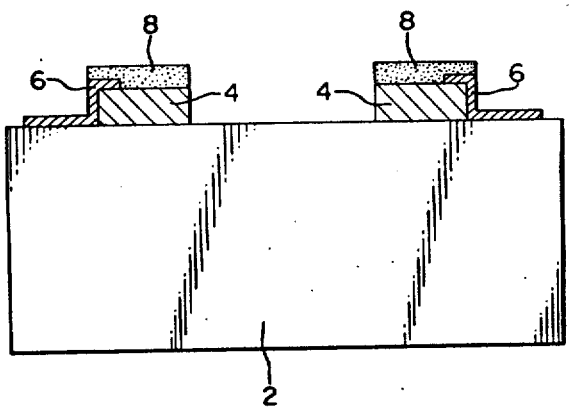

Signed and Sealed this

*Eighteenth* Day of *September 1979*

[SEAL]

*Attest:*

*Attesting Officer*

LUTRELLE F. PARKER

*Acting Commissioner of Patents and Trademarks*